United States Patent [19]

Downing et al.

[11] Patent Number: 4,560,071

[45] Date of Patent: Dec. 24, 1985

[54] DISPLAY DEVICES FOR DISPLAYING FISHING POLES AND FISHING REELS

[75] Inventors: Jack G. Downing, Cincinnati, Ohio; Erwin W. Dewald, Dry Ridge, Ky.; David Hayes, Harrison, Ind.

[73] Assignee: Downing Displays, Inc., Cincinnati, Ohio

[21] Appl. No.: 574,333

[22] Filed: Jan. 27, 1984

[51] Int. Cl.[4] ..... A47F 5/08

[52] U.S. Cl. ..... 211/70.8; 211/59.1; 211/87; 248/205.2

[58] Field of Search ..... 211/60 R, 70.8, 87, 211/106, 59.1; 248/205.2, 220.2, 205.3, 302, 303

[56] References Cited

U.S. PATENT DOCUMENTS 1,933,218 10/1933 Miller ..... 248/303 X 4,441,619 4/1984 Gibitz ..... 211/59.1 X

FOREIGN PATENT DOCUMENTS 173297 5/1952 Fed. Rep. of Germany ... 248/205.3

*Primary Examiner*—Robert W. Gibson, Jr.

*Attorney, Agent, or Firm*—Wood, Herron & Evans

[57] ABSTRACT

A novel device for displaying fishing poles and fishing reels is disclosed. The display device comprises means for supporting a pin for insertion into an aperture of a fishing pole for display. The pin is generally straight or in the shape of a hook, particularly an "S" shaped hook, and extends generally outwardly and upwardly from the support means. If desired, the fishing pole can include a fishing reel. Further, the support means can be easily attached to a display structure for expeditious location and relocation. The display device of this invention also contemplates the employment of conventional fishing rods and preferably abbreviated conventional fishing rods.

3 Claims, 3 Drawing Figures

DISPLAY DEVICES FOR DISPLAYING FISHING POLES AND FISHING REELS

BACKGROUND OF THE INVENTION

In order to display the handle portion of a fishing rod or the rod itself, it is common practice to display the entire fishing rod in, for example, a case having a receptacle or notch for receiving the handle portion of the rod and a receptacle or notch for receiving some portion of the pole section of the rod. The rods are normally displayed side-byside and require a suitable amount of wall and/or floor space for the presentation of a significant number of styles and sizes of rods. Representative of such a display device is disclosed in U.S. Pat. No. 3,004,673.

Another form of a display device employs a support means having numerous projections wherein the support means is secured to a wall or other upstanding structure. The projections receive the guide rings attached to the pole portion of the fishing rod to display the same. Thus, like the above display device, this display device displays the entire fishing rod. A sample display device of this type is disclosed in U.S. Pat. No. 4,162,015.

With respect to displaying fishing reels, they are often exposed to more abuse than the fishing rods since the fishing reels are generally displayed unsecured in counter spaces or other unsuitable places where damage may easily result to their delicate components. Further, if the combination of a rod and reel is to be displayed, the entire fishing rod has to be displayed resulting in the disadvantages discussed above. Still further, when fishing reels are displayed in counter spaces, generally only visual inspection is available to the prospective buyer.

In order to overcome some of the difficulties associated with displaying fishing reels, U.S. Pat. No. 4,003,612 provides for a rack wherein fishing reels are mounted onto columns in a substantially vertical position. Unfortunately, the fishing reels have to be mounted on supports other than fishing rods and they must be completely removed from the supports to be physically inspected. Additionally, the rack disclosed therein cannot be easily adjusted to accommodate various displaying locations.

In brief, there are needs for display devices that can easily and expeditiously display fishing poles and fishing reels for physical and visual inspection by prospective buyers without experiencing the disadvantages described above.

SUMMARY OF THE INVENTION

In brief, the present invention seeks to alleviate the above-indicated problems and shortcomings of the present state of the art and is directed to a simplified display device for displaying fishing poles and fishing reels. In a preferred form, the display device comprises means for supporting a pin wherein the pin is adapted for insertion into an aperture of a fishing pole for removably mounting the fishing pole thereon for display. Preferably, when the fishing pole being displayed is a conventional fishing rod, the fishing rod is in an abbreviated form to display the handle. Additionally, the fishing pole can include a fishing reel for displaying the same.

In one embodiment in accordance with the invention, the display device employs a pin affixed to a support means, the pin of which extends generally outwardly and upwardly and is generally straight or in the shape of a hook, especially an "S" shaped hook.

In another embodiment, the fishing pole is apertured for directly receiving the pin, or the fishing pole can be secured to an angular downwardly bent tube having an aperture for receiving the pin to display the same. In either case, the fishing pole or reel can be displayed in such a fashion to permit easy removal and replacement for physical and visual perusal by prospective rod and reel buyers.

In another embodiment, the support means is provided with a cooperative fastener component for attaching the support means to a display structure having a corresponding fastener component. The cooperative fastener component provides for the display device of this invention to be attached to a display structure in a novel and expeditious manner. Additionally, the cooperative fastener enables the display device to be quickly and easily located and relocated to accommodate various displaying locations even by relatively unskilled persons.

Thus, the display devices of the present invention are economical to manufacture, easy to install, easy to use by both store proprietors and their customers and permits the display of a large number of fishing poles and fishing reels in a minimum amount of space.

The above and other features of the invention, including various novel details of construction and combination of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown illustrative embodiments of the invention from which its novel features and advantages will be apparent.

DETAILED DESCRIPTION OF THE INVENTION

Figure 1:
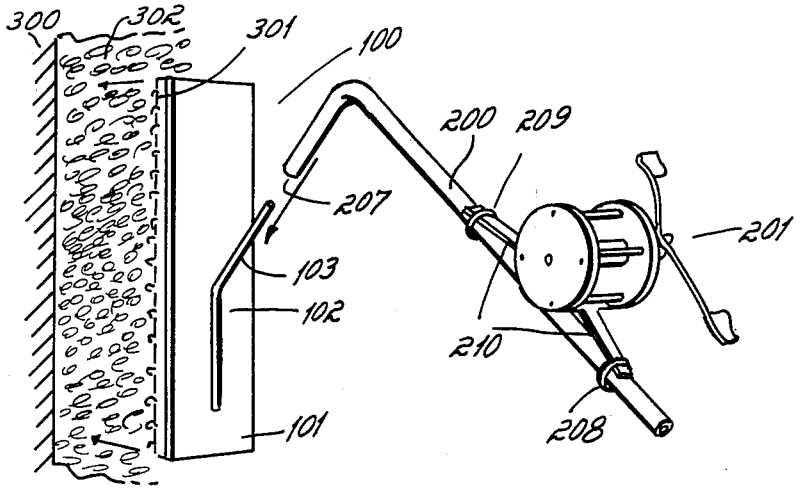
FIG. 1 is a perspective view of one form of a display device which is illustrative of an embodiment of the invention.

A display device 100, embodying the principles of the invention, is depicted in the drawings to illustrate a presently preferred form of the invention.

Figure 2:
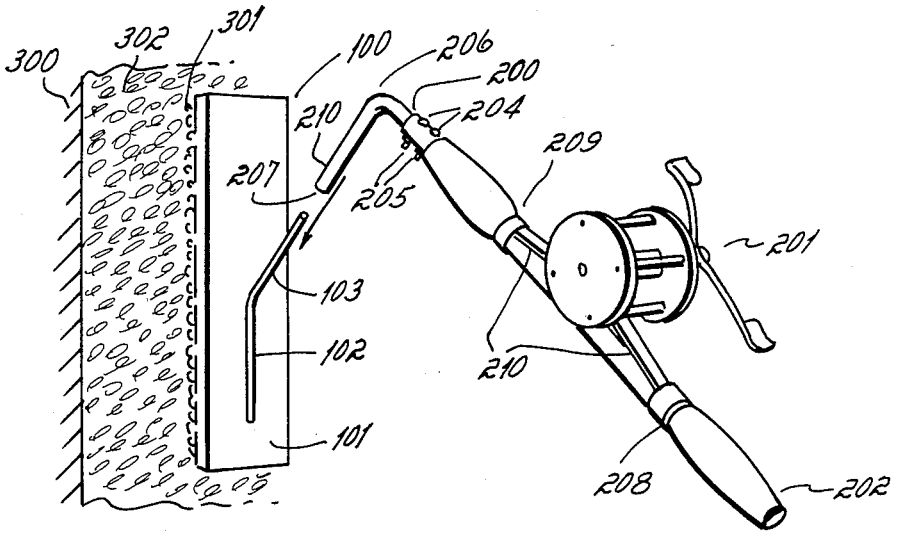
FIG. 2 is a perspective view of another form of a display device which is illustrative of an embodiment of the invention.
Figure 3:
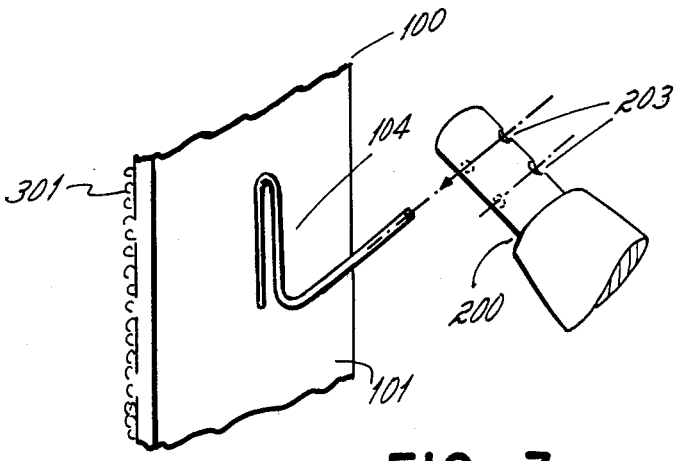
FIG. 3 is a sectional view of another form of a display device which is illustrative of an embodiment of the invention.

Referring to FIGS. 1–3, the display device 100 comprises, in general, support means or a base 101. The base 101 is of any suitable material and preferably of a light, rigid material, such as a light metal, wood or rigid plastic. Preferably, the base 101 is of flat plate-like construction having a front side and a back side and provides the required rigidity and lightness.

Affixed to the base 101 and extending generally outwardly and upwardly is a pin 102 or a hook 104 as illustrated in FIGS. 1–2 and 3, respectively. In keeping with the invention, the pin 102 or hook 104 may extend generally outwardly and perpendicular to the base 101. Like the base 101, the pin 102 or hook 104 is of any suitable material and preferably of a light, rigid material, such as a light metal, wood or rigid plastic. Preferably, the extending portion 103 of the pin 102 is generally straight while the hook 104 is generally in the shape of an "S".

The display device 100 is so constructed that a fishing pole or the like having an aperture, such as, for example, the fishing pole 200 having an aperture 203, as depicted in FIG. 3 may be mounted on the hook 104, or, if desired, the pin 102 of the base 101. When the fishing pole 200 is displayed in such a position it can be quickly and easily mounted on or removed from the pin 102 or hook 104 for physical and visual inspection.

Additionally, the fishing pole 200 can be adapted to receive one end 209 of an angular downwardly bent supporting tube 206. The end 209 of tube 206 should be apertured (not shown) to correspond with the apertures 203 of fishing pole 200. Thusly, the tube 206 can then be secured at end 209 to the fishing pole 200 by screws 204 and corresponding nuts 205. At the other end 210 of tube 206 is an aperture 207 for receiving the pin 102 or the hook 104 for displaying the fishing pole 200. When a fishing pole utilizing the tube 206 is employed, it is preferred that the pin 102 or hook 104 extends generally outwardly and upwardly at such an acute angle to enable the fishing pole 200 to be displayed at an acute angle to the base 101 as illustrated in FIGS. 1 and 2. Furthermore, such a displayed fishing pole can pivot freely about the pin 102 or hook 104. When the pin is extending outwardly and perpendicular to the base (not shown), the tube or fishing pole preferably is straight. It should be understood, however, that the angular downwardly bent tube 206 can be an extension of the fishing pole 200, as shown in FIG. 2, or can be an integral part of the fishing pole, as depicted in FIG. 1. Of course, any of the fishing poles illustrated in FIGS. 1–3 or contemplated by this invention can include a fishing reel, such as, for example, fishing reel 201 for displaying the same.

By the term "fishing pole," it is meant to include any form of support suitable for mounting thereon a fishing reel. The fishing pole can be, for example, a hollow tube as depicted in FIG. 1, or it can be any conventional fishing rod. Preferably, when a conventional fishing rod is employed having a fishing reel mounted thereon for display purposes, the fishing rod is in an abbreviated form, such as fishing pole 200 illustrated in FIG. 2. By the term "abbreviated," it is meant to refer to fishing rods or poles that have been modified to accommodate the display devices of this invention. Additionally, it is preferred for the fishing pole 200 to have a handle, such as, for example, handle 202 of fishing pole 200, to provide a more realistic assembly for the prospective buyers. In any event, regardless of the type of fishing pole selected to display a fishing reel mounted thereon, it should be understood that the fishing pole should be apertured for receiving the pin 102 or hook 104 of the display device 100.

Generally, any fishing pole employed with this invention will have a handle portion and a mounting portion having the aperture to receive the pin 102 or hook 104. It should be understood that the mounting portion can be an integral part of the handle portion or an extension thereof. For example, in FIG. 2, fishing pole 200 constitutes the handle portion while tube 206 represents the mounting portion while in FIGS. 1 and 3 fishing pole 206 constitutes both the handle portion and mounting portion.

The base 101 has an attaching means or a large preferably rectangular velcro component or patch 301 on its back side with the patch preferably spanning the entire width and length of the base 101. A display structure 300, such as a wall or other upstanding structure, carries a corresponding velcro component or patch 302 for attaching the base 101 to the display structure 300. Preferably, the loop pile component 302 is on the display structure 300 while the mating or hook multiple component 301 is attached to the back side of the base 101, as shown in FIG. 1 and 2. In keeping with the invention, the base 101 may be mounted on a display structure by any other suitable means, such as, for example, providing a base 101 with an aperture (not shown) for receiving a support rod secured to a display structure or the base 101 can be sufficiently modified to support several pins (not shown) for displaying an equal number of fishing poles and rods.

In use, the display device 100, is mounted onto the display structure 300 by way of corresponding velcro components 301 and 302 described above. The fishing pole 200 is displayed upon the pin 102 or hook 104 by inserting the pin 102 or hook 104 into the aperture 203 or 207 of the fishing pole 200. The angle of the pin 102 or hook 104 provides for the angle at which the fishing pole is displayed. Additionally, when the tube 206 is employed, the tube 206 further can affect the angle at which the fishing pole 200 is displayed. It is preferred, however, that regardless of which display device is employed the fishing poles are displayed at an acute angle to the base 101. If desired, a fishing reel 201 can be mounted onto the fishing pole 202 and secured thereon, for example, by O-rings 208 and 209 which slip over the end portions of the yoke 210 of the fishing reel 201. When displaying fishing poles with either display device 100, i.e., with the pin 102 or hook 104, the displayed fishing poles can pivot freely about the pin 102 or hook 104.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A device for displaying a fishing pole comprising a pin, means for supporting the pin, said pin is generally straight and extends generally outwardly and upwardly at an acute angle from said support means and a fishing pole having a handle portion and a mounting portion, the handle portion having a fishing reel mounted thereon and the mounting portion having an angular downwardly bent tube, the angular downwardly bent tube having an aperture for receiving the pin to removably mount thereon said fishing pole for displaying said fishing pole and said fishing reel.

2. The device of claim 1 wherein said support means comprises a generally flat plate having a front portion and a back portion, the front portion having the pin affixed thereto and the back portion having a cooperative fastener component for attaching said flat plate to a display structure having a corresponding cooperative fastener component.

3. The device of claim 2 wherein said fishing pole and fishing reel are displayed at an acute angle to said flat plate.

* * * * *